United States Patent [19]

French

[11] 4,238,090

[45] Dec. 9, 1980

[54] ALL-WEATHER INTERCEPT OF TANKS FROM A HELICOPTER

[75] Inventor: John A. French, Huntsville, Ala.

[73] Assignee: The United States of America as represented by the Secretary of the Army, Washington, D.C.

[21] Appl. No.: 944,833

[22] Filed: Sep. 22, 1978

[51] Int. Cl.[3] ..... F41G 7/22

[52] U.S. Cl. ..... 244/3.19

[58] Field of Search ..... 244/3.14, 3.16, 3.19

[56] References Cited

U.S. PATENT DOCUMENTS

| | | | |
|---|---|---|---|
| 2,424,193 | 7/1947 | Rost et al. | 244/3.16 |
| 2,448,007 | 8/1948 | Ayres | 244/3.19 |
| 2,590,574 | 3/1952 | Robinson | 102/3 |
| 2,704,513 | 3/1955 | Dane, Jr. | 102/3 |
| 3,189,300 | 6/1965 | Robert | 244/3.19 |
| 4,143,836 | 3/1979 | Rieger | 102/3 |

OTHER PUBLICATIONS

Gifford E. White, "Guidance for Missiles", COAST ARTILLERY JOURNAL, Nov.-Dec. 1946, pp. 18-22.

"The 'Bat' Guided Bomb," COAST ARTILLERY JOURNAL, Nov. 14 Dec. 1946, p. 22.

*Primary Examiner*—Stephen C. Bentley

*Attorney, Agent, or Firm*—Nathan Edelberg; Robert P. Gibson; Robert C. Sims

[57] ABSTRACT

A radar is used for detecting and locating threat tanks. The selected target tank bearing and range are displayed to the helicopter pilot who directs the helicopter course accordingly to aim missiles toward the target. Range to the target is inserted into a computer which determines launch elevation and predicts time of flight. Based on a predetermined time delay after launch, a seeker in the missile begins searching for the target. Upon acquiring the target, the missile seeker tracks the target and enables homing to intercept.

1 Claim, 2 Drawing Figures

ALL-WEATHER INTERCEPT OF TANKS FROM A HELICOPTER

DEDICATORY CLAUSE

The invention described herein may be manufactured, used, and licensed by or for the Government for governmental purposes without the payment to me of any royalties thereon.

BACKGROUND OF THE INVENTION

The problem of intercepting tanks in a military engagement normally involves optical or visual detection by one or several of the elements of the weapon system. Presently fielded weapons are limited to optical or infrared band operation in order to achieve the initial tank detection, location and the accuracy necessary to achieve a high probability of effectiveness. This requires conditions of good visibility which in turn exposes the antitank system to counterfire and the resultant destruction of unarmored launch vehicles such as a helicopter or other light aircraft. Further, the effectiveness of antitank weapons is restricted to clear weather conditions and often daytime. Therefore, the effectiveness of antitank weapons can be enhanced and their vulnerability to counterfire simultaneously greatly reduced by the utilization of microwave type sensors with their foul weather operability.

Prior use of radar type sensors in this application has been inhibited by several factors, namely, lack of accuracy, lack of ability to identify and distinguish tanks from their background (clutter) and, in some cases, too short range of operations.

A reasonable standoff range is a necessity for the same reasons as above, effectiveness and vulnerability. It is evident that a short range system (e.g., less than one or two kilometers) will be vulnerable to counterfire, since it must often be employed in clear/daylight conditions as well as low visibility conditions. Additionally, weapon effectiveness is enhanced by ability to attack targets at longer ranges and the resultant greater freedom of target selection.

It is therefore concluded that a system concept which is capable of operation in inclement weather, day or night and has a range of several kilometers, is desirable, assuming it can be applied by equipment compatible with a helicopter or comparable vehicle.

A further desirable attribute is the "fire-and-forget" feature. This important capability is embodied in the autonomy of the missile once it leaves the launcher. Many system concepts employ command control and/or target designation/illumination throughout the missile's time of flight. This further worsens the vulnerability of the operating forces, delaying their opportunity to take evasive action in the event of enemy counterfire.

It is the objective of this invention to provide a system concept employing a combination of equipments installed on a helicopter, fixed-wing aircraft, or ground vehicle whereby:

a. Enemy tanks or other ground vehicles can be detected and located under foul weather and other low visibility conditions.

b. A missile can be launched from a range of greater than two kilometers.

c. The missile midcourse and terminal phases will be self-contained and autonomous, enabling a true fire-and-forget capability.

d. The target will be intercepted with a high probability of kill.

SUMMARY OF THE INVENTION

The present invention is directed to the method and apparatus for detecting tanks, locating them relative to the weapons carrying aircraft or helicopter, providing the operating crew with displays and firing coordinates data, launching a missile, initiating seeker homing and intercepting the tank.

A radar is mounted aboard the helicopter to detect the tank and provide coordinates via a plan position type of display. Target coordinates and aircraft flight parameters are fed to a computer aboard the helicopter. Computer solutions of the initial engagement geometry are sent back to the display with pilot instructions for aircraft headings, velocity, etc. Upon achieving proper helicopter heading, velocity, and position relative to the target, the computer will initiate the missile firing sequence and launch the missile. A timer on board the missile will initiate seeker search. Upon target acquisition by the seeker, the missile will begin proportional navigation and intercept the tank. Destruction of the target will typically be by a shaped charged warhead initiated by a contact fuze.

DESCRIPTION OF THE PREFERRED EMBODIMENT

Figure 1:
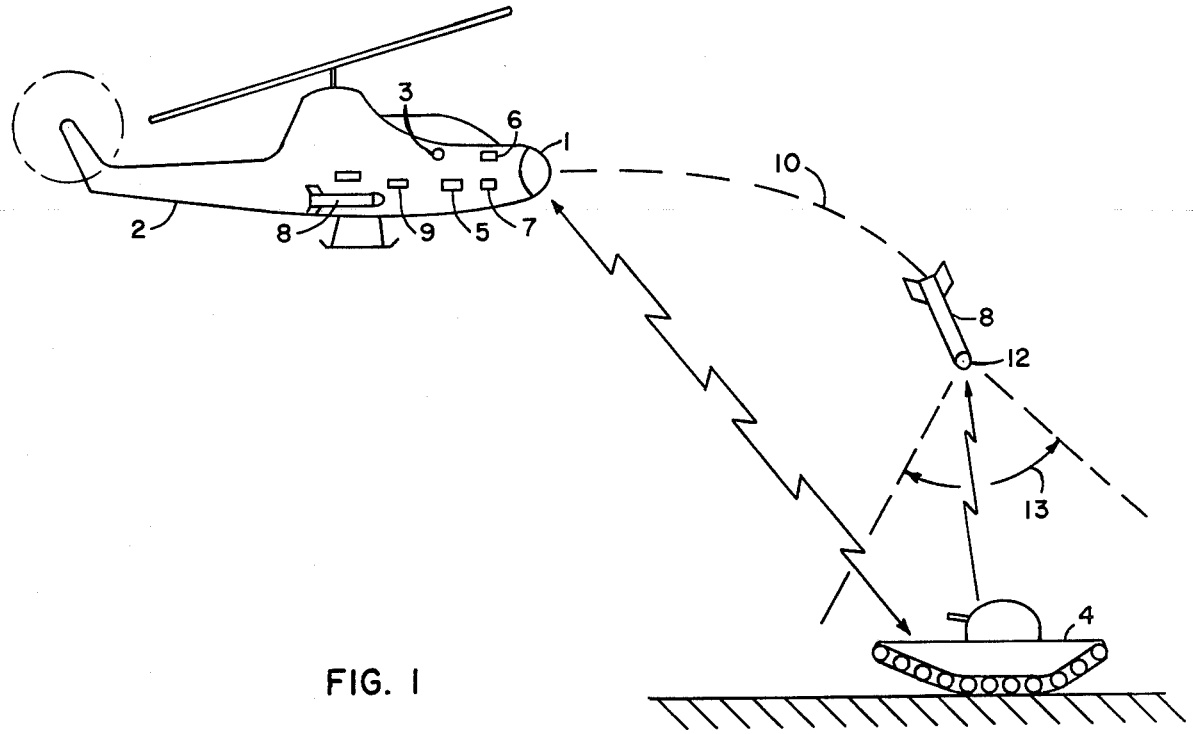
FIG. 1 is a diagrammatic illustration of the preferred embodiment of the present invention.
Figure 2:
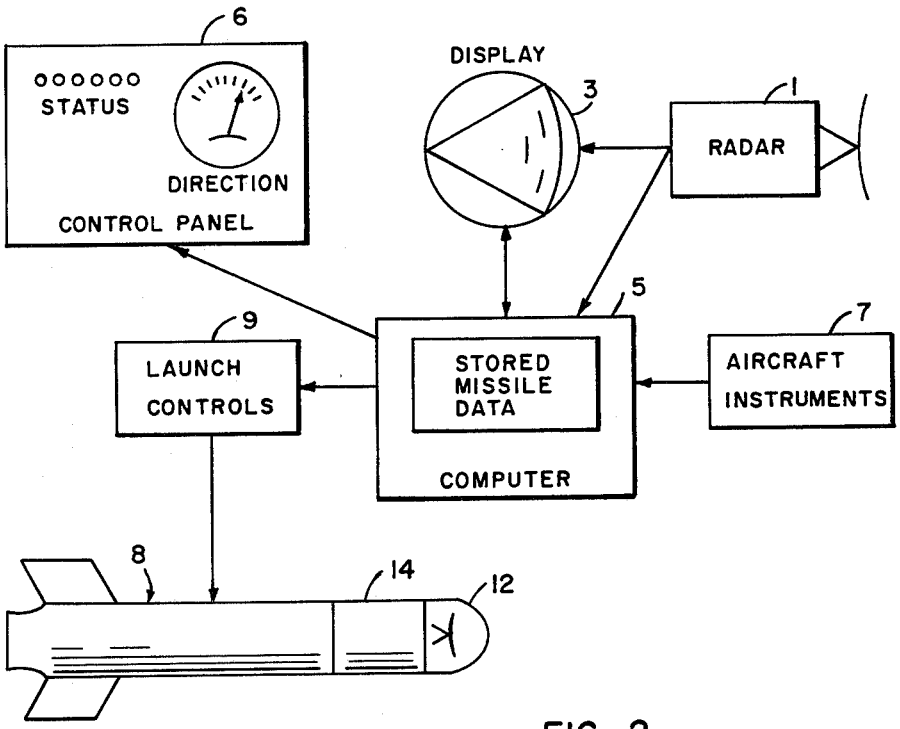
FIG. 2 is a schematic representation of the preferred embodiment of the present invention.

Radar 1 (referring to FIGS. 1 and 2) incorporates pulse doppler techniques as described in Radar Handbook by Skolnik, chapter 19, or other suitable techniques. It is located in such a position on the helicopter 2 as to have unobstructed search visibility over a large solid angle. The radar 1 provides a display 3 of the searched area which will include targets such as the tank 4. Upon automatic or manual designation of the selected target by the system operator (possibly the helicopter co-pilot), the radar data is provided to the computer 5, in terms of range, azimuth and elevation angle, relative to the helicopter position.

By virtue of knowing target location and having stored missile flight characteristics, the computer can compute the intercept geometry and determine the proper helicopter heading and time of launch in a fashion similar to an air-to-air or air-to-surface missile system computation. This and other status information is furnished to the helicopter crew by any of several types of displays on the control panel 6.

As the crew decides to engage a target, the helicopter's required heading and velocity are accomplished by the pilot. Aircraft instruments 7 transfer this data to the computer. When a satisfactory solution is achieved, the computer so indicates on the status panel 6, and the missile 8 is fired either automatically or manually through the launcher control circuit 9.

The missile assumes a ballistic or modified ballistic flight path until it achieves a position 10 in the vicinity of and aimed toward the target 4. Because of deviations in computer input data from actual parameters (e.g., caused by temperature, wind, atmospheric density variations and/or target motion), the missile will normally not be aimed directly at the target. In general, it is not possible to hit a tank sized target with a ballistic rocket at an appreciable distance with a high probability of confidence. Therefore, a seeker 12 is required to make corrections in the terminal phase of flight. The seeker is initiated by timer circuits 14 and searches a wide angle 13 centered about the longitudinal axis of the missile.

To meet the all-weather requirement, the seeker must operate in the microwave spectrum. To meet the fire-and-forget objective, the seeker must be self-contained, i.e., it cannot rely on an illumination or command signal from the launch helicopter or other source. Therefore, the preferred implementation is the use of microwave radiometric receiver for sensing target direction based on variations in microwave emissivities between metallic targets and nonmetallic background as discussed in Skolnik, chapter 39. Other autonomous type microwave seekers may be satisfactory. Once the seeker senses the target location, homing to intercept can be accomplished by pursuit or (preferably) proportional navigation.

Since no control need be exercised by the launching helicopter after the launch, the crew is completely free to take evasive action or to undertake engagement of successive targets in rapid order.

I claim:

1. A method of detecting a tank from a remote location in a helicopter which carries a missile and sends the missile against said tank comprising the steps of locating a tank relative to the helicopter by the use of a pulse doppler radar system; aligning the helicopter in the direction of the tank by the use of a computer system; aligning the missile on a ballistic path towards the tank, and activating the missile's homing system after a predetermined time so the missile will home onto the tank; using fire-and-forget tactics for the helicopter; utilizing pulse doppler radar to detect the tank in any optical visibility conditions; providing tank bearing and range information to the pilot on a display, so that he may direct the aircraft to a proper course for firing of the missile; utilizing the range and bearing information of the helicopter's instruments as inputs to the computer system so as to detect a proper ballistic missile firing path to the tank; and using a microwave radiometric receiver in said missile's homing system for sensing the tank's direction based on variations in microwave emissivities between metallic targets and non-metallic background.

* * * * *